United States Patent [19]

Mill et al.

[11] 3,997,077

[45] Dec. 14, 1976

[54] CONTAINERS WITH SCREW CAPS

[75] Inventors: Patrick J. Mill, Beaconsfield; John C. Walkley, High Wycombe, both of England

[73] Assignee: G. D. Searle & Co. Ltd., Bucks, England

[22] Filed: Nov. 12, 1975

[21] Appl. No.: 631,283

[30] Foreign Application Priority Data

Nov. 13, 1974 United Kingdom ..... 49094/74

[52] U.S. Cl. ..... 220/288; 215/329; 215/354

[51] Int. Cl.[2] ..... B65D 41/04

[58] Field of Search ..... 220/288, 304; 215/341, 215/354, 329

[56] References Cited

UNITED STATES PATENTS 2,965,256 12/1960 Yochem ..... 215/354 X 3,540,612 11/1970 Brady ..... 215/354 X

*Primary Examiner*—George T. Hall

*Attorney, Agent, or Firm*—John A. Dhuey

[57] ABSTRACT

The present invention relates to a container which has a removable screw cap. Said screw cap comprises an outer sleeve, a portion of which is provided with an internal screw-thread arranged to cooperate with an external screw-thread on the container, an inner cylindrical spigot or plug secured at one end within the sleeve by a bridge portion and arranged to fit inside the container, a plurality of flanges or rings on the spigot or plug, the said flanges or rings being arranged to make an interference fit with the inside of the container and a closure diaphragm closing the spigot or plug. The instant container is useful in diagnostic work, for example, to contain blood samples.

3 Claims, 1 Drawing Figure

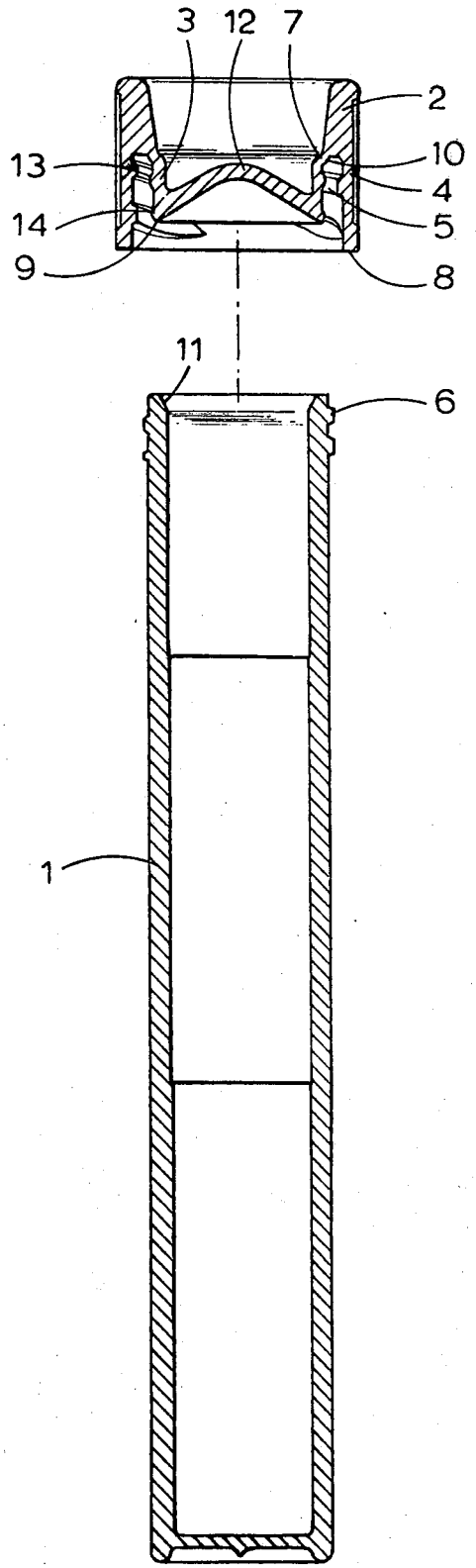
3
12
7
2
13
10
4
14
5
9
8
11
6
1

CONTAINERS WITH SCREW CAPS

This invention relates to containers for use in diagnostic work, for example, to contain blood samples.

According to the invention, such a container has a screw cap which cap comprises an outer sleeve, a portion of which is provided with an internal screw-thread arranged to co-operate with an external screw-thread on the container, an inner cylindrical spigot or plug secured at one end within the sleeve by a bridge portion and arranged to fit inside the container, a plurality of flanges or rings on the spigot or plug, the said flanges or rings being arranged to make an interference fit with the inside of the container and a closure diaphragm closing the spigot or plug.

The closure diaphragm is preferably a domed diaphragm. The bridge portion may have a bevel which co-operates with a complementary bevel on the container to form a flexible seal.

The single FIGURE of the accompanying drawing is an exploded sectional view of a container according to the invention.

In the illustrated embodiment of the invention, a tubular container 1 is closed at one end and is open at the other. The open end of the container is closed by a removable screw cap 2. Both the container and the cap are preferably made of a material such that they are easily disposable, the screw cap being conveniently made of polyethylene and the tubular container being conveniently made of polystyrene. For convenience of description, the open end of the tubular container will hereinafter be considered to be the upper end of the container. The cap 2 has a central cylindrical spigot or plug portion 3 which fits inside the open upper end of the container 1 and an outer sleeve portion 4 the lower part of which has an internal screw-thread 5 which co-operates with an external screw-thread 6 at the upper end of the container. The top of the spigot or plug portion 3 is connected with the inside of the sleeve 4 by an annular bridge portion 7. The lower edge or rim 8 of the sleeve 4 is below the lower edge 9 of spigot or plug 3 and the upper edge or rim of the sleeve is above that of the spigot or plug.

The underside of the bridge portion 7 is bevelled at 10, i.e., is inclined upwards and outwards from the upper edge of the spigot or plug and a complementary bevel 11 is provided on the upper edge or rim of the tubular container 1. The bevel 10 on the underside of the bridge portion is at a less acute angle than the complementary bevel 11 on the container. The bevelled underside 10 of the bridge portion forms a flexible seal with the bevelled upper edge of the container.

Diminution of the cross sectional thickness of the plastics material in the bevel region of the cap 2 provides sufficient flexibility to form the seal, whereas the greater cross sectional thickness of the remainder of the cap provides sufficient mechanical rigidity for its successful operation.

The central spigot or plug 3 is closed by an upwardly convex domed diaphragm 12. The outer surface of the spigot or plug has two internal rings or flanges 13, 14 called "scraper" rings. These scraper rings 13, 14 are an interference fit with the internal wall of the container tube 1. The lower one (14) of these scraper rings is preferably flush with the lower edge of the spigot or plug, so that a trap for liquid in the annular space between the sleeve and the spigot or plug will not be formed.

The outer surface of the sleeve is knurled.

The screw cap is formed as a unitary moulding.

What we claim is:

1. A screw cap for a liquid container having an external screw thread thereon which comprises an outer sleeve, a portion of which has an internal screw thread arranged to co-operate with an external screw thread on the container; an inner cylindrical plug secured at one end within the sleeve by a bridge portion and arranged to fit inside the container; a flange at the bottom, outer peripheral edge of the plug, said flange being arranged to make an interference fit with the inside of the container; and an upwardly convex, domed closure diaphragm closing the plug, said domed diaphragm and said flange being integrally joined at the bottom edge of said plug and forming an upwardly convex, continuous surface.

2. A screw cap as in claim 1 wherein the bridge portion has a bevel which co-operates with a complementary bevel on the container to form a flexible seal.

3. A screw cap as in claim 1 wherein said plug has a plurality of flanges thereon arranged to make an interference fit with the inside of the container.

* * * * *